US005666616A

United States Patent [19]

Yoshino et al.

[11] Patent Number: 5,666,616

[45] Date of Patent: Sep. 9, 1997

[54] WET-TYPE IMAGE FORMING APPARATUS FOR FORMING A CONDENSED TONER IMAGE

[75] Inventors: Mie Yoshino, Kawasaki; Makoto Obu; Takeo Tsukamoto, both of Yokohama; Seiichi Miyakawa, Nagareyama; Yusuke Takeda; Masami Hiramatsu, both of Yokohama, all of Japan

[73] Assignee: Ricoh Company, Ltd., Tokyo, Japan

[21] Appl. No.: 542,724

[22] Filed: Oct. 13, 1995

[30] Foreign Application Priority Data

Oct. 24, 1994 [JP] Japan ..... 6-284423
May 31, 1995 [JP] Japan ..... 7-158558

[51] Int. Cl.[6] ..... G03G 15/10

[52] U.S. Cl. ..... 399/240; 399/237

[58] Field of Search ..... 355/256, 257, 355/258, 245; 118/659, 660, 661, 662; 399/237, 239, 240, 241

[56] References Cited

U.S. PATENT DOCUMENTS

| | | | |
|---|---|---|---|
| 3,907,423 | 9/1975 | Hayashi et al. . | |
| 4,161,361 | 7/1979 | Soma et al. . | |
| 4,310,238 | 1/1982 | Mochizuki et al. . | |
| 4,325,627 | 4/1982 | Swidler et al. . | |
| 4,327,664 | 5/1982 | Ohkawa et al. . | |
| 4,761,357 | 8/1988 | Tavernier et al. | 118/661 X |
| 5,028,964 | 7/1991 | Landa et al. . | |
| 5,036,366 | 7/1991 | Berg et al. | 355/256 |
| 5,202,534 | 4/1993 | Tamiya et al. . | |

FOREIGN PATENT DOCUMENTS

| | | |
|---|---|---|
| 66 06 209 | 9/1970 | Germany . |
| 6-282175 | 10/1974 | Japan . |
| 58-187963 | 11/1983 | Japan . |
| 63-178277 | 7/1988 | Japan . |
| 4-503265 | 6/1992 | Japan . |

*Primary Examiner*—Sandra L. Brase
*Attorney, Agent, or Firm*—Oblon, Spivak, McClelland, Maier & Neustadt, P.C.

[57] ABSTRACT

A wet-type image forming apparatus produces a high-quality toner image by condensing a toner image on a photosensitive drum and adhering the toner image onto the photosensitive drum without contacting a liquid carrier applied on the photosensitive drum. The photosensitive drum carries a latent image formed thereon. The toner image is formed by developing the latent image by using a developing liquid including the liquid carrier and toner dispersed in the liquid carrier. An excessive amount of liquid carrier on the photosensitive drum is removed after the toner image is formed. An electric field is formed which causes a current to flow between an electrically conductive member and the photosensitive drum. An air gap is formed between the liquid carrier on the photosensitive drum and the electrically conductive member so that the current flows through the gap, the liquid carrier and the toner image. The toner image on the photosensitive drum is transferred to a transfer material after the toner image passes an area in which the electric field is generated.

24 Claims, 12 Drawing Sheets

WET-TYPE IMAGE FORMING APPARATUS FOR FORMING A CONDENSED TONER IMAGE

BACKGROUND OF THE INVENTION

1) Field of the Invention

The present invention generally relates to a wet-type image forming apparatus such as a copy machine, facsimile machine or a printer and, more particularly, to a wet-type image forming apparatus in which toner in a liquid carrier applied on a latent image carrier is cohered prior to a transferring process.

2) Description of the Related Art

A wet-type image forming apparatus is known which uses a developing liquid comprising a liquid carrier and toner dispersed in the liquid carrier. A toner image is formed on a latent image carrier such as a photosensitive drum by using the developing liquid. The toner image is then transferred onto a transfer material such as a recording sheet or an intermediate transfer belt. In this apparatus, a phenomenon, which is referred to as electrostatic migration, of the toner in the liquid carrier is utilized so as to adhere the toner onto the latent image carrier during a developing process, or move the toner from the latent image carrier to the transfer material during a transferring process.

In the above-mentioned conventional wet-type image forming apparatus, a thin layer of the liquid carrier having 30–200 μm thickness is formed on the latent image carrier when the developing liquid is applied onto the latent image carrier. If the developed toner image is transferred onto the transfer material by pressing the transfer material onto the latent image carrier in the above-mentioned condition, the toner image developed on the latent image carrier is deformed. The deformation of the toner image includes the collapse of an image and swelling of a line. Thus, the toner image cannot be precisely transferred onto the transfer material. This is because an excessive amount of the liquid carrier exists on the latent image carrier. If the excessive amount of liquid carrier exists on the latent image carrier, the toner of the toner image may move in the liquid carrier.

Additionally, when the transferring process is performed when the excessive amount of the liquid carrier exists, a large amount of liquid carrier is transferred onto the transfer material. Thus, there is a problem in that consumption of the liquid carrier is increased, and extra heat and extra time is required for drying the liquid carrier on the transfer material.

In order to eliminate the above-mentioned problems, the excessive amount of the liquid carrier is removed from the latent image carrier. The removal of the excessive amount of the liquid carrier can be achieved by providing a squeeze roller or a corona discharging device at a predetermined distance apart from the latent image carrier. The squeeze roller is rotated in a reverse direction of the rotating direction of the latent image carrier to catch the excessive amount of the liquid carrier. The corona discharging device generates ions having the same polarization with the toner and irradiates the ions toward the latent image carrier. These methods for removing the excessive amount of the liquid carrier are known in the art.

However, if too much amount of the liquid carrier is removed, a part of the toner image transferred onto the transfer material may possibly be removed and the toner image may have a blank. This is because the above-mentioned electrostatic migration is not sufficiently achieved when a sufficient amount of liquid carrier does not exist.

Japanese Laid-Open Patent Application No. 4-503265 discloses a method in which toner in a toner image formed on the latent image carrier is condensed before it is transferred onto a transfer material by an electric field formed between a roller and the latent image carrier. The toner image is condensed by an effect of the electric field. In this method, a sufficient amount of the liquid carrier is applied onto the latent image carrier and, thus, the roller always contacts the liquid carrier on the latent image carrier. Accordingly, a shearing stress is generated in the liquid carrier near a position at which the roller is most closely adjacent to the latent image carrier on the downstream side of the latent image carrier. This is because a part of the liquid carrier on the latent image carrier is separately carried by the roller. When the shearing stress is generated, the toner image of the latent image carrier is disturbed, and a part of the toner adheres on the latent image carrier other than the area where the toner image should be formed. This phenomenon is referred to as scattering of toner. The scattering of toner is generated particularly in a position near the trailing edge of the toner image on the latent image carrier. When a voltage is applied to the roller, the scattering of the toner is particularly increased. When the scattering of the toner is generated in the liquid carrier, sharpness at the edge of the toner image is decreased and a fillet may be formed at a leading edge or a trailing edge of a line. Thus, a high-quality toner image on the transfer material cannot be obtained.

It should be noted that the effect of the scattering of the toner may be decreased as the toner image is transferred onto the recording sheet via the intermediate transfer material. However, the scattering of the toner considerably deteriorates the toner image when the toner image is directly transferred onto the recording sheet without having the intermediate transfer material as is in image forming apparatus according to the present invention.

SUMMARY OF THE INVENTION

It is a general object of the present invention to provide an improved and useful wet-type image forming apparatus in which the above-mentioned problems are eliminated.

A more specific object of the present invention is to provide a wet-type image forming apparatus which can produce a high-quality toner image by condensing the toner image on the latent image carrier and adhering the toner image onto the latent image carrier without contacting the liquid carrier applied on the latent image carrier.

In order to achieve the above-mentioned objects, there is provided according to the present invention a wet-type image forming apparatus comprising:

- a latent image carrier carrying a latent image formed thereon;
- developing means for developing the latent image formed on the latent image carrier, a toner image being formed by developing the latent image by using a developing liquid including a liquid carrier and toner dispersed in the liquid carrier;
- excessive liquid removing means for removing an excessive amount of the liquid carrier on the latent image carrier after formation of the toner image on the latent image carrier;
- electric field generating means for generating an electric field so as to cause a current to flow between the electric field generating means and the latent image carrier, an air gap being formed between the liquid carrier on the latent image carrier and the electric field generating means so that the current flows through the gap, the liquid carrier and the toner image; and transferring means for transferring the toner image on the latent image carrier to a transfer material after the toner image has passed an area in which the electric field is generated.

According to the above-mentioned invention, since the current flows from the electric field generating means to the latent image carrier via the gap and the toner image, an electrostatic attracting force between the toner particles is increased. This promotes the condensation of the toner image and the adhesion of the toner image onto the latent image carrier. Accordingly, the toner image maintains its shape and position even if a sufficient amount of liquid carrier exists on the latent image carrier for performing a good transferring operation. This results in a formation of a high-quality image on the transfer material. Additionally, since the air gap is formed between the electric field generating means and the liquid carrier adhering on the latent image carrier, the electric field generating means does not contact the liquid carrier in which the toner image is formed. Accordingly, no shearing force is generated in the liquid carrier when the toner image is moved from the area where the electric field is generated to an area where the toner image is transferred onto the transfer material. Thus, scattering of toner particles due to the shearing force is prevented, resulting in a high-quality image transferred on the transferring material.

Conditions of the electric field generated by the electric field generating means is determined so that toner particles constituting the toner image in the liquid carrier move toward a surface of said latent image carrier, the toner particles being electrically charged. The movement of the toner is generated by an electrostatic attracting force caused by the electric field.

Additionally, conditions of the electric field are determined so that an absolute value of a potential of a surface of the latent image carrier is decreased, the toner image being formed on the surface of the latent image carrier. This prevents the surface of the latent image carrier from being damaged due to a high potential.

Further, conditions of the electric field are determined so that a weigh ratio of toner particles contained in the toner image to an entire toner image is increased. This decreases the distance between the toner particles contained in the toner image. Thus, an attracting force effected between the toner particles is increased, resulting in prevention of deformation of the toner image.

Further, conditions of the electric field preferably causes a non-pulsed corona discharge or a grow discharge which allows a continuous current flowing between the electric field generating means and the latent image carrier. This results in a uniform condensing effect over the entire toner image.

In one embodiment according to the present invention, the electric field generating means comprises an electric field roller having a rotational axis perpendicular to a direction in which the toner image formed on the latent image carrier is moved. The electric field roller is rotated when an image forming operation is performed so as to prevent generation of an abnormal electric field due to foreign matter adhering on the electric field roller.

Additionally, the developing means comprises a developing roller and the excessive liquid removing means comprises a squeeze roller. Further, the latent image carrier comprises a photosensitive drum. Preferably, distances between the photosensitive drum and each of the developing roller, the squeeze roller and the electric field roller are determined so that a third distance between the electric field roller and the photosensitive drum is equal to or less than a first distance between the developing roller and the photosensitive drum, the third distance being greater than a second distance between the squeeze roller and the photosensitive drum.

In one embodiment according to the present invention, a constant voltage supplying source is provided which applies a constant voltage to the electric field roller so that the electric field has a constant intensity. The electric field generating means further comprises current detecting means for detecting a current flowing between the electric field roller and the photosensitive drum and controlling means for controlling the constant voltage supplying source so that the constant voltage applied to the photosensitive drum is varied in accordance with the current detected by the current detecting means.

In one embodiment according to the present invention, the electric field generating means further comprises current detecting means for detecting a current flowing between the electric field roller and the photosensitive drum and controlling means for controlling the constant voltage supplying source so that the constant voltage applied to the electric field roller is interrupted when the current detected by the current detecting means is outside of a predetermined current range.

In one embodiment according to the present invention, a constant current supplying source supplies the voltage to the electric field roller so as to maintain a constant current flowing to the electric field roller. The voltage applied to the electric field roller is detected by voltage detecting means. Controlling means controls the constant current supplying source to interrupt the voltage applied to the electric field roller when the voltage detected by the voltage detecting means is outside of a predetermined voltage range.

Other objects, features and advantages of the present invention will become more apparent from the following detailed description when read in conjunction with the accompanying drawings.

BRIEF DESCRIPTION OF DRAWINGS

FIG.2A shows a state of the developing liquid after passing a developing roller; FIG.2B shows a state of the developing liquid after passing a squeeze roller;

FIG. 3A shows a case in which a voltage is not applied to an electric field roller; FIG. 3B shows a case in which a voltage is applied to the electric field roller;

DETAILED DESCRIPTION OF THE PREFERRED EMBODIMENT

Figure 1:
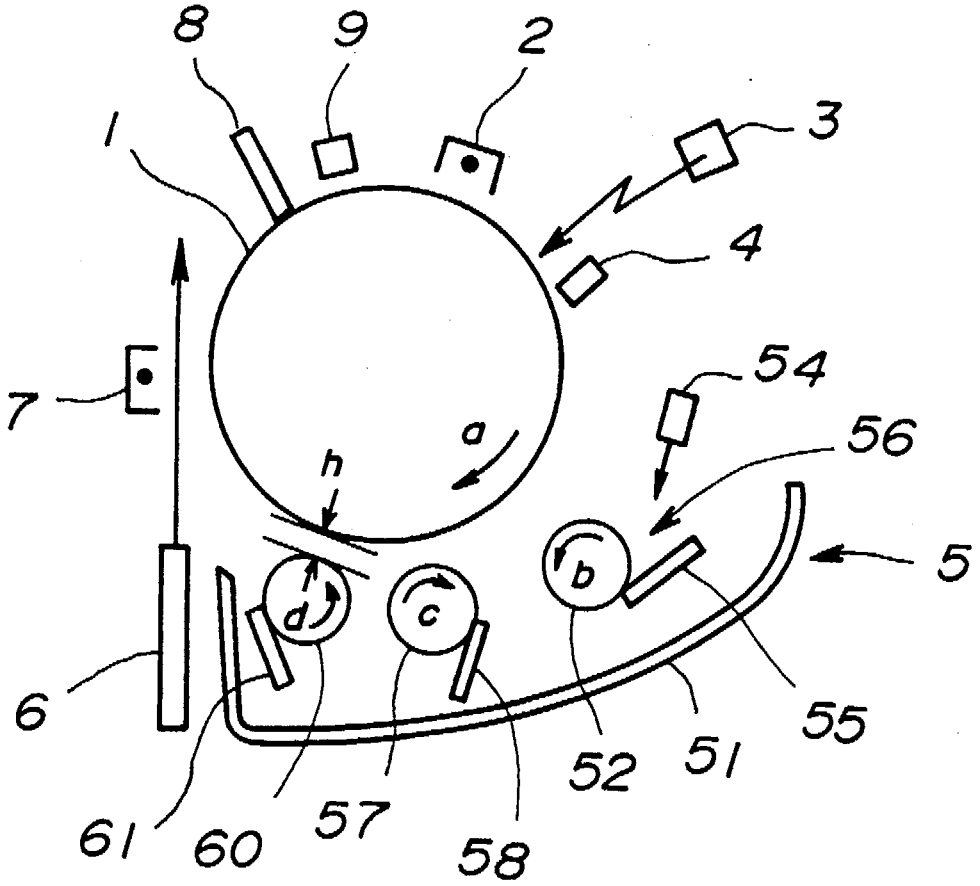
FIG. 1 is an illustration of a part of a wet-type image electrophotographic copy machine according to a first embodiment of the present invention.

A description will now be given, with reference to FIG. 1, of an embodiment of the present invention. FIG. 1 is an illustration of a part of a wet-type image electrophotographic copy machine (hereinafter simply referred to as a copy machine) according to a first embodiment of the present invention.

In FIG. 1, a photosensitive drum 1, which serves as a latent image carrier, is rotated in a direction indicated by an arrow a by driving means such as a motor (not shown in the figure) during a copying operation. An entire outer surface of the photosensitive drum 1 is charged uniformly by a main charger 2. Thereafter, an electrostatic latent image is formed on the outer surface of the photosensitive drum 1 by projecting an optical image by a laser scanner 3. The electric charge remaining on the photosensitive drum 1 is removed by an eraser 4. The electrostatic latent image formed on the photosensitive drum 1 is developed into a toner image by developing liquid while the electrostatic latent image passes through an area formed between the photosensitive drum 1 and a wet-type developing device 5. The developing liquid includes a liquid carrier and toner dispersed in the liquid carrier. The toner image is transferred onto a transfer paper 6, which is fed by a paper supplying device not shown in the figure, by means of a transfer charger 7. That is, the toner image on the photosensitive drum 1 is transferred onto the transfer paper 6 by means of electrostatic migration. After the transfer paper 6 is separated from the photosensitive drum 1, the toner remaining on the photosensitive drum 1 is removed by a cleaning blade 8. The cleaning blade 8 can be oriented either in a trailing direction or a counter direction. Thereafter, an electric charge remaining on the photosensitive drum 1 is removed by a discharge lamp 9 to prepare for the next copying cycle.

In the wet-type developing device 5, there is provided a developing roller 52 as a developing liquid carrier, a squeeze roller 57 as excessive liquid removing means and an electric field roller 60 as a conductive roller of an electric field generating means, in that order. The developing roller 52, the squeeze roller 57 and the electric field roller 60 are accommodated inside a developing vessel 51 which stores the developing liquid, and are positioned adjacent to the photosensitive drum 1.

As an alternative to the developing roller 52, a developing dish or a sponge roller may be used. The developing roller 52 used in this embodiment is rotated in a direction indicated by an arrow b which direction is opposite to the rotating direction of the photosensitive drum 1. A developing liquid supplying unit 54 is positioned above the developing roller 52 so as to supply the developing liquid to the developing roller 52. A scraper 55 is provided to the developing roller 52 in a position in which an end of the scraper 55 contacts an outer surface of the developing roller 52. The developing liquid supplied by the developing liquid supplying unit 54 is collected in an area formed between the developing roller 52 and the scraper 55, and is carried to a developing area formed between the photosensitive drum 1 and the developing roller 52 by means of a rotation of the developing roller 52. The developing roller 52 is applied with a developing bias so as to prevent the toner from adhering onto an area corresponding to a background of the image.

In an alternative to the squeeze roller 57, a corona discharge device or an air knife is used. In the present embodiment, the squeeze roller 57 is used and the rotational speed is varied for controlling the thickness of a layer of the liquid carrier adhering on the photosensitive drum 1. The squeeze roller 57 is preferably made of aluminum and has a surface which is anodized to have a resistance of more than $10^9$ Ωcm. The squeeze roller 57 removes an excessive amount of liquid carrier on the photosensitive drum 1 by rotating in a direction indicated by an arrow c. The rotational direction c of the squeeze roller 57 is opposite to the rotational direction of the photosensitive drum 1. A squeeze roller scraper 58 is provided to the squeeze roller 57 in a position in which an end of the squeeze roller scraper 58 contacts an outer surface of the squeeze roller 57. The squeeze roller scraper 58 removes the liquid carrier adhering on the squeeze roller 57.

When a corona discharge device is used as the corona squeezing means, ions having the same polarity as the toner are generated by the corona discharge device. In this embodiment, the polarity of the toner is negative. The excessive amount of the liquid carrier is removed by irradiating the ions onto the photosensitive drum 1. It is considered that the squeeze roller is superior in squeezing the excessive amount of the liquid carrier to obtain an appropriate thickness of a layer corresponding to the toner area and the background area (non-image area).

Figure 2A:
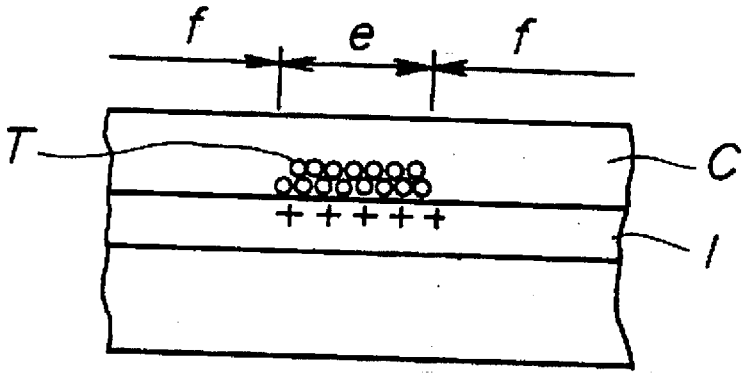
FIGS. 2A and 2B are illustrations showing developing liquid adhering on a photosensitive drum shown in FIG. 1.
Figure 2B:
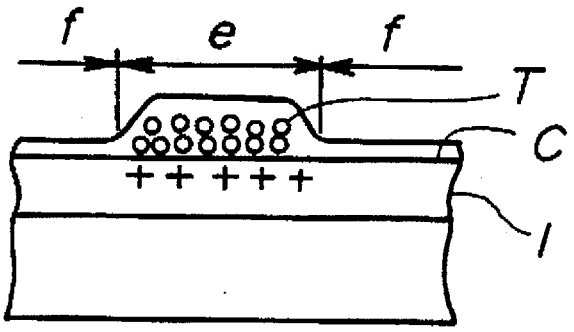

FIGS. 2A and 2B show the developing liquid adhering on the photosensitive drum 1; FIG. 2A shows a state of the developing liquid after passing the developing roller 52; FIG. 2B shows a state of the developing liquid after passing the squeeze roller 57.

In the state shown in FIG. 2A, a toner image T is covered by a layer c of the liquid carrier. A thickness of the layer of the developing liquid is 30–200 μm. The state of the developing liquid in the layer is different from that of the developing liquid as supplied by the developing liquid supplying device 54. That is, the liquid carrier in the layer corresponding to the background area f contains little toner since most of the toner in the liquid carrier is collected to the area where the electrostatic latent image is formed, and thus the toner in the liquid carrier corresponding to the background area f is far less than the toner contained in the regular developing liquid.

In the state shown in FIG. 2B, the excessive amount of the liquid carrier is appropriately removed from the photosensitive drum 1 by the squeeze roller 57. That is, the thickness of the layer of the liquid carrier in background area f is less than the thickness of the liquid carrier in the toner image area e. More specifically, the thickness of the layer corresponding to the background area f is less than 5 μm, and the thickness of the toner image area e is less than 10 μm.

The electric field roller 60 is made of a conductive material. The electric field roller 60 is positioned adjacent to the photosensitive drum 1 but not in contact with the liquid carrier remaining on the photosensitive drum 1 which has passed the squeeze roller 57. A predetermined voltage is applied to the electric field roller 60 so as to generate an electric field (about 200 kV/cm) so that a current Isr flows between the electric field roller 60 and the photosensitive drum 1 via an air gap and the toner image in the liquid carrier. The voltage applied to the electric field roller 60 is a direct current voltage. An alternating voltage may be superimposed on the direct current voltage so that a condition for condensing the toner is selected from a wide range by selecting a frequency or a level of the alternating voltage.

When the current Isr flows between the sensitive drum 1 and the electric field roller 60 via the air gap and the toner image, the toner image adhering on the photosensitive drum 1 is further condensed. It is considered that the reason for the condensation of the toner image is that a Johnsen-Rahbeck force acts on each toner particle in the toner image. Since each toner particles has an electric resistance, a partial potential drop is generated due to contact resistance between the toner particles. Accordingly, an high-intensity electric field is generated resulting in a capacitance between the toner particles. Since the toner particles used for the wet-type copy machine have a diameter of less than 1 μm, gaps between the toner particles are very small. This condition corresponds to the left side increasing part of the Paschen's spark discharge curve. Thus, a large Maxwell force is generated due to the increase in the destructive electric field intensity. This causes a mutual adhesion of the toner particles, and results in the condensation of the toner image.

Figure 3B:
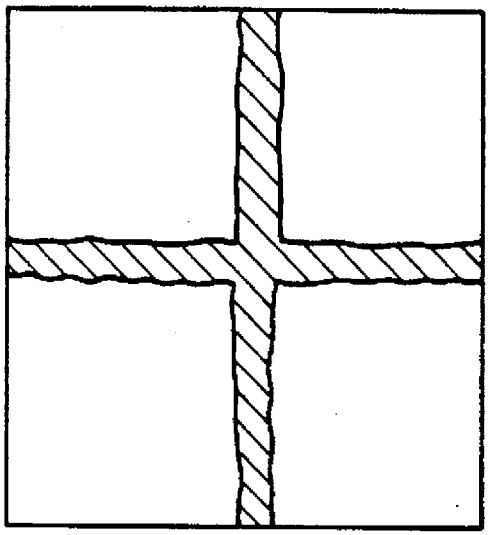
FIGS. 3A and 3B are enlarged views of a toner image having a cross-like shape transferred onto a transfer paper.
Figure 3A:
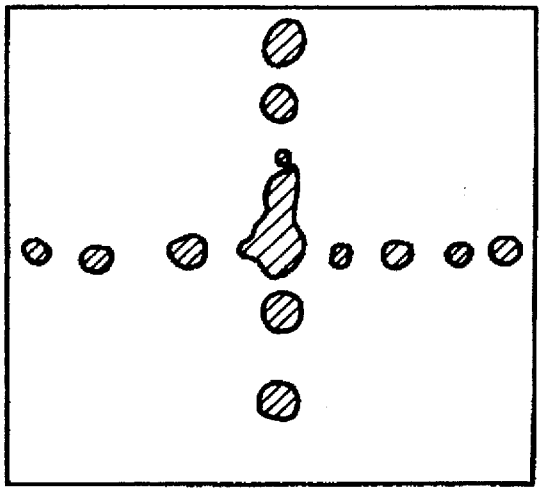

Effect of the above-mentioned condensation of the toner image appears apparently in the toner image transferred onto the transfer material such as the transfer paper 6. FIGS. 3A and 3B are enlarged views of the toner image having a cross-like shape transferred onto the transfer paper 6; FIG. 3A shows a case in which a voltage is not applied to the electric field roller 60; FIG. 3B shows a case in which a voltage is applied to the electric field roller 60. As shown in FIG. 3A, the toner image is disrupted due to an insufficient condensing force in the toner image if the predetermined voltage is not applied to the electric field roller 60. On the contrary, FIG. 3B shows a continuous toner image in which a sufficient condensing force is generated in the toner image since the predetermined voltage is applied to the electric field roller 60.

In this embodiment, the predetermined voltage applied to the electric field roller 60 generates an electric field between the photosensitive drum 1 and the electric field roller 60 so that the discharge current Isr flows between the photoelectric drum 1 and the electric field roller 60. The electric discharge should be a non-pulsed corona discharge or a grow discharge. If a brush corona discharge or a pulsed corona discharge is generated in a part of the area between the photosensitive drum 1 and the electric field roller 60, the discharge current Isr is concentrated and flows only in that part. This generates uneven distribution of the effect on the condensation of the toner image. As a result, a toner image is formed in which the toner images shown in FIGS. 3A and 3B are mixed.

In the present embodiment, in order to generated a stable non-pulsed or grow discharge, a constant voltage is applied to the electric field roller 60, and a gap between the photosensitive drum 1 and the electric field roller 60 is set to have a predetermined width. Additionally, the electric field roller 60 is rotated in a direction indicated by an arrow d in FIG. 1 by means of a motor (not shown in the figure) so that a surface of the electric field roller facing the photosensitive drum 1 maintains a uniform surface condition. This is because if the same part of the electric field roller 60 is always opposite to the photosensitive drum 1, the surface of that part is deteriorated over time. In such a condition, the brush corona discharge or the pulsed corona discharge tends to be generated. This situation happens when too large gap is formed between the photosensitive drum 1 and the electric field roller 60.

Figure 4:
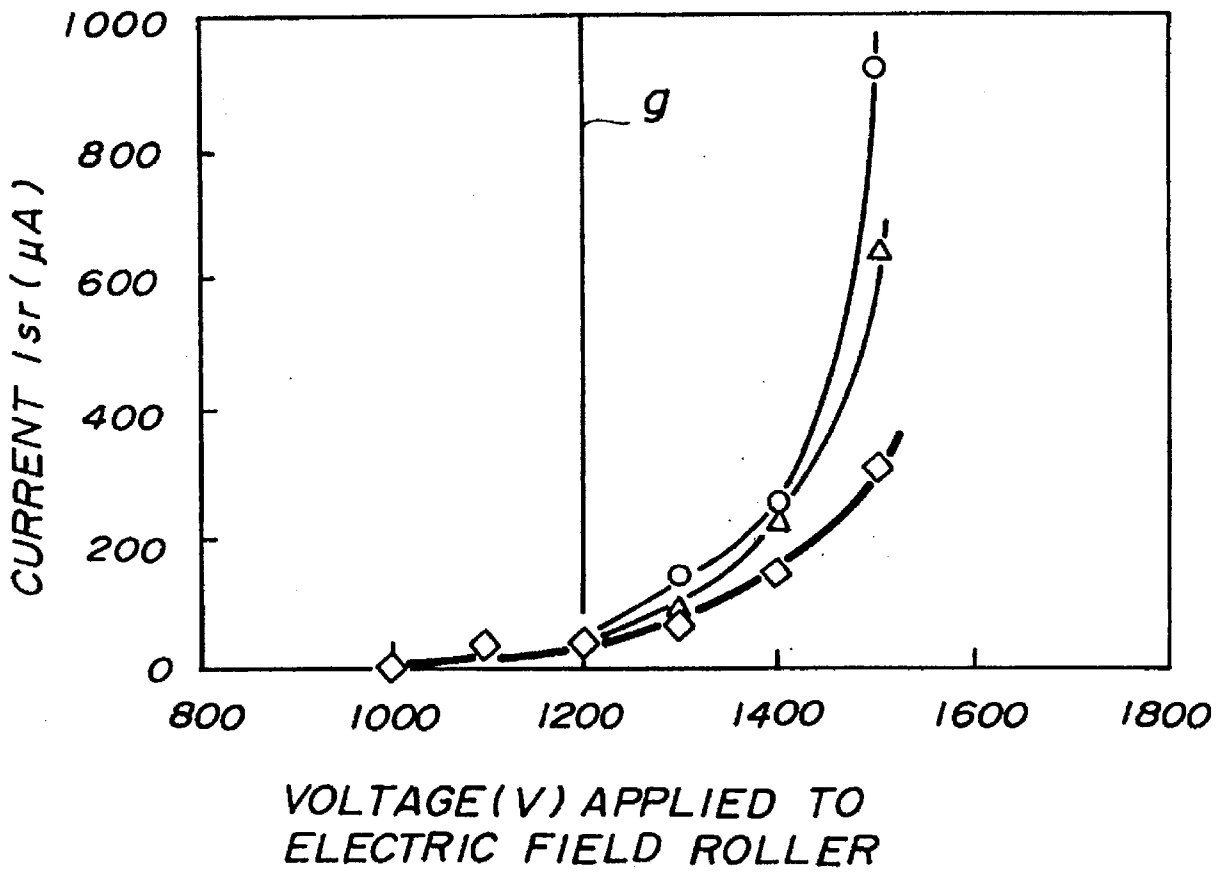
FIG. 4 is a graph showing a relationship between a current flowing between the photosensitive drum and the electric field roller and a voltage applied to the electric field roller.

FIG. 4 is a graph showing a relationship between the current Isr flowing between the photosensitive drum 1 and the electric field roller 60 and a voltage applied to the electric field roller 60. In the graph, a datum point indicated by a circle represents data obtained when a toner image is not formed; a datum point indicated by a triangle represents data when a black image having a width of 125 mm is formed; a datum point indicated by a square represents data when a black image having a width of 225 mm is formed. In the graph, a remarkable effect on the condensation of the toner image was obtained on the right side of the line g. It is appreciated from the graph that the current Isr starts to increase from the line g when the voltage applied to the roller 60 is gradually increased. It is also appreciated from the graph that less current flows in the toner image area than the background area. Additionally, less current flows as the area of the toner image area is increased. Further, there is a case in which a current flows only in the background area. Accordingly, the voltage applied to the electric field roller 60 has to be set to a level in which at least a current flows in the toner image area.

Figure 5:
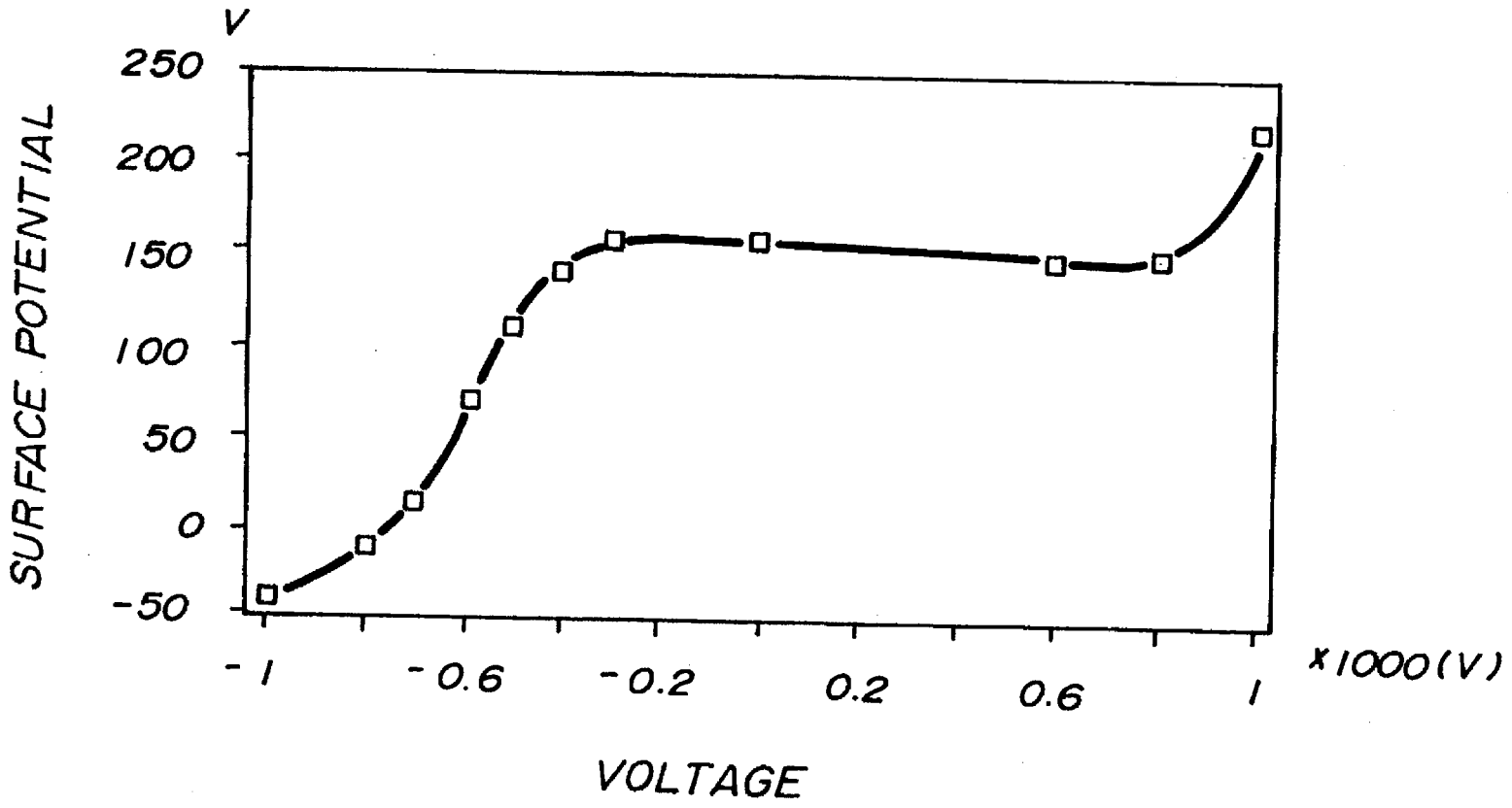
FIG. 5 is a graph showing a relationship between a surface potential of the photosensitive drum and the voltage applied to the electric field roller.

It was observed by experiments that if the voltage applied to the electric field roller 60 is sufficient for changing a surface potential of the photosensitive drum 1, a good toner image can be formed without deformation, such as collapse of the image, swelling of a line or a flow of the toner. FIG. 5 is a graph showing a relationship between the surface potential of the photosensitive drum 1 and the voltage applied to the electric field roller 60. When the voltage applied to the electric field roller 60 decreased, the surface potential of the photosensitive drum 1 began to decrease at a voltage of −300 V. When a toner image is formed under a negative voltage having an absolute value greater than 300 V, deterioration of the toner image due to deformation was decreased. A good toner image having little deformation was obtained when a negative voltage having an absolute value of 800 V was applied. At the same time, the surface voltage of the photosensitive drum 1 is decreased to approximately 0 V. This condition allows a good transfer of the toner image onto the transfer paper 6 during the subsequent transfer process since the electrostatic attracting force between the toner particles forming the toner image and the photosensitive drum 1 is decreased.

A weight percent ratio of the toner particles to the entire toner image in the developing liquid adhering on the photosensitive drum 1 was measured in a condition where the toner image was condensed by the electric field generated by the electric field roller 60, that is, the deformation of the toner image was reduced. The weight percent ratio measured was 10 to 20 % higher than that measured in the toner image in the developing liquid in a state where no condensation is effected. It is assumed that when the weight percent ratio of the toner particles is increased, an attracting force exerted on each toner particle is increased since the distance between the adjacent toner particles is reduced. Thus, each toner particle tends to firmly adhere on the surface of the photosensitive drum 1, resulting in prevention of the deformation of the toner image.

The electric field roller 60 can be made of a metal such as steel or aluminum material or other electrically conductive materials. The surface of the electric field roller 60 can be a bare metal surface, but preferably a resistive layer is provided by a surface treatment such as thermal spraying or anodization so as to extend the range of conditions for generating the above-mentioned non-pulsed corona discharge or the grow discharge. Accordingly, the resistive layer must have a resistance which induces the non-pulsed corona discharge or the grow discharge.

In the present embodiment, the developing roller scraper 55, the squeeze roller scraper 58 and the electric field roller scraper 61 are made to contact the developing roller 52, the squeeze roller 57 and the electric field roller 60, respectively. Each of the scrapers 55, 58 and 61 removes the developing liquid on the respective rollers 52, 57 and 60 when the rollers are rotated. Actually, a very thin layer of the developing liquid remains on the rollers 52, 57 and 60 when the developing liquid is removed by the respective scrapers 55, 58 and 61. The material of the scrapers 58 and 61 and the pressing force against the rollers 57 and 60, in particular, are determined so that the thin layer of the developing layer has a thickness of less than 1 μm. However, the thickness of the layer for the electric field roller 60 may be permitted to a few micro millimeters when the layer of the developing liquid on the electric field roller 60 has a uniform thickness. With regard to the developing roller scraper 55, there is no limitation with respect to a thickness of the layer since the developing liquid is supplied to the developing roller 52 after the developing liquid remaining on the developing roller 52 is removed by the scraper 55. However, since the toner is attracted by the developing roller 52 due to the developing bias, a pressing force should be applied to the scraper 55 so as to prevent generation of a toner line which is formed along a circumferential direction of the roller.

Figure 6:
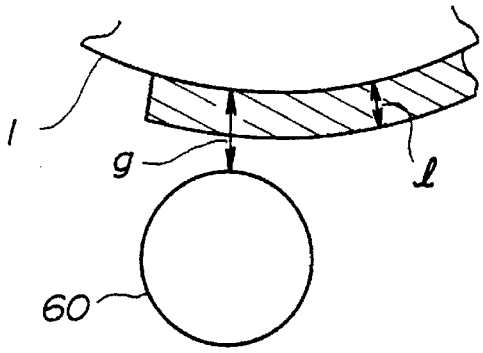
FIG. 6 is an illustration for explaining a gap between the photosensitive drum and the electric field roller.

In the present embodiment, as shown in FIG. 6, the electric field roller 60 is positioned so as to not contact the developing liquid adhering on the photosensitive drum 1. That is, a distance g between the photosensitive drum 1 and the electric field roller 60 is greater than the thickness 1 of the developing liquid adhering on the photosensitive drum 1. Accordingly, an air gap is formed between the electric field roller 60 and the developing liquid on the photosensitive drum 1. This provides a remarkable effect for preventing the deformation of the toner image as compared to the conventional arrangement of the electric field roller 60 which contacts the developing liquid. Due to the air gap, the electric field is concentrated which results in the condensation of the toner image as mentioned above. Thus, the toner image does not move along the surface of the photosensitive drum 1. Additionally, since the electric field roller 60 is not in contact with the developing liquid, the shearing stress is not generated in the developing liquid, shearing stress being generated due to the separation of the developing liquid. Therefore, deterioration of toner image due to scattering of the toner is prevented.

On the assumption that widths of the gaps between the photosensitive drum 1 and each of the rollers 52, 57 and 60 are designated as a developing roller gap g1, a squeeze roller gap g2 and a field roller gap g3, respectively, it is preferable to set the widths of the gaps to satisfy the relationship $g1 \geqq g3 > g2$. As described with reference to FIG. 2A, the layer of the developing liquid on the photosensitive drum 1 has the thickness of 30–200 μm. The gap g1 is one of the factors which determine the thickness of the developing liquid on the photosensitive drum 1. The gap g1 must be set so that a large particle present in the developing liquid is not caught in the developing roller gap g1. This is to prevent an irregular operation of the photosensitive drum 1 and to prevent the photosensitive drum 1 from being damaged. A filter may prevent the large particles from flowing into the gap g. However, there is a possibility that the filter may be clogged by the toner particles. If a filter is provided to remove the large particles, e.g., 100 μm or more, the developing roller gap g1 has to be set to more than 100 μm.

The layers of the developing liquid shown in FIG. 2B are formed on the photosensitive drum 1 after it passed the squeeze roller 57. In order to reduce the thickness of the liquid carrier layer to be less than the thickness of the toner image layer, a smaller squeeze roller gap g2 is preferable. However, if the gap g2 is too narrow, the toner image is deformed by the squeeze roller 57. This is because the squeeze roller 57 may contact the toner image or generate a shearing force in the toner image via the liquid carrier which is moved by rotational movement of the squeeze roller 57. Accordingly, the squeeze roller gap g2 must be set so that the thickness of the liquid carrier layer becomes minimum and the toner image is not deformed. The gap g2 is preferably set to 30 to 60 μm.

The electric field roller gap g3 is set, as mentioned before, so as to not contact the developing liquid on the photosensitive drum 1. When the developing liquid does not contact the electric field roller 60 in the absence of a voltage applied to the field roller 60, the developing liquid may contact the electric field roller 60 when the voltage is applied thereto due to the toner image being attracted by the electric field roller 60 which is caused by the electric field formed between the electric field roller 60 and the photosensitive drum 1. A layer of the developing liquid, which remains after the removal of the developing liquid by the electric field roller scraper 61, may trigger the developing liquid to contact the electric field roller 60. In order to eliminate those problems, it is preferable to set the electric field roller gap g3 to be wider than the squeeze roller gap g2. By this setting of the gaps, the non-pulsed corona discharge or the grow discharge can be effectively generated between the electric field roller 60 and the photosensitive drum 1. If the developing roller gap g1 is 70–100 μm, the optimum condition was to set the electric field gap g3 to be the same as the developing roller gap g1.

It should be noted that, in the above mentioned embodiment, although the electric field roller 60 is used as the electric field generating means, a corona discharge device or an electrically conductive plate-like member (hereinafter referred to as a plate electrode) may be used instead.

Figure 7:
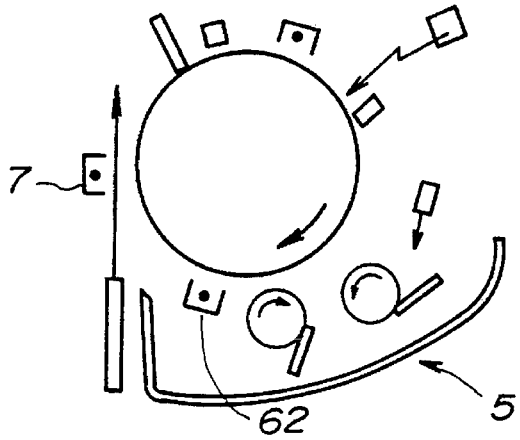
FIG. 7 is an illustration showing a second embodiment in which a corona discharge device is used as the electric field generating means.

FIG. 7 is an illustration showing a second embodiment in which a corona discharge device 62 is used as the electric field generating means. Positioning pf the corona discharge device 62 does not require a highly accurate determination of the distance between the corona discharge device 62 and the photosensitive drum 1 for obtaining a relatively uniform toner condensing effect. The corona discharge device 62 has a discharge wire extending in a direction perpendicular to a direction in which the toner image on the photosensitive drum 1 is moved.

Figure 8:
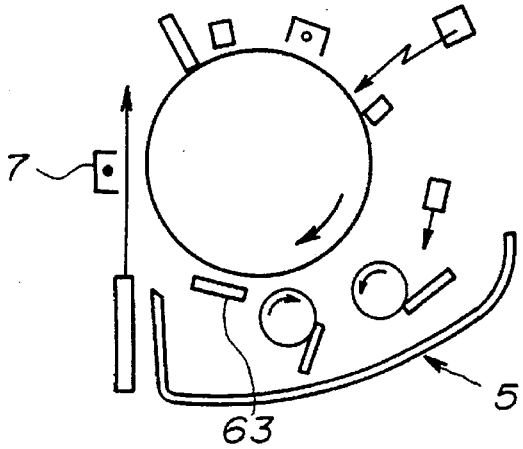
FIG. 8 is an illustration of a third embodiment in which an plate electrode is used as the electric field generating means.

FIG. 8 is an illustration of a third embodiment in which an plate electrode 63 is used as the electric field generating means. Since the electrode plate 63 can maintain the gap formed between the electrode plate 63 and the photosensitive drum i at a high degree of accuracy, a stable and constant electric field can be obtained between the electrode plate 63 and the photosensitive drum 1. AS the material for the electrode plate 63, similarly to the electric field roller 60, a metal such as steel or aluminum material or other electrically conductive materials may be used. The surface of the electrode plate 63 can be a bear metal surface, but preferably a resistive layer is provided by a surface treatment such as thermal spraying or anodization so as to form a resistive layer which has an appropriate resistance inducing the non-pulsed corona discharge or the grow discharge.

In the above mentioned first embodiment, if the intensity of the current flowing to the electric field roller 60 is too high (this means an excessive voltage is applied to the electric roller 60), the material of the photosensitive drum 1 deteriorates or a spark discharge is generated between the electric field roller 60 and the photosensitive drum 1. The generation of the spark discharge causes damage to the electric field roller 60 or the photosensitive drum 1. Thus, there is a problem in that reliability of the apparatus is decreased. Additionally, the spark discharge may occur when the voltage is applied when the photosensitive drum 1 or the electric field roller 60 is not rotated. The spark discharge may also occur when there is a flaw in the photosensitive drum 1 or the electric field roller 60. In a case where the spark discharge occurs, the electric current flowing to the electric field roller 60 is remarkably increased. 0n the other hand, when the gap between the electric field roller 60 and the photosensitive drum 1 is filled with the liquid carrier, the current flowing to the electric field roller 60 is remarkably decreased as compare to the normal current.

Figure 9A:
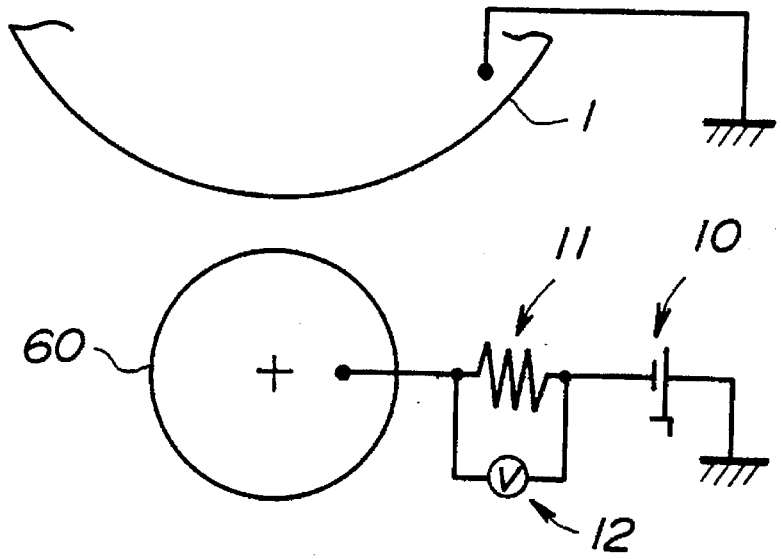
FIGS. 9A and 9B are illustrations for explaining a current (voltage) detecting circuit for measuring the current flowing between the photosensitive drum and the electric field roller.
Figure 9B:
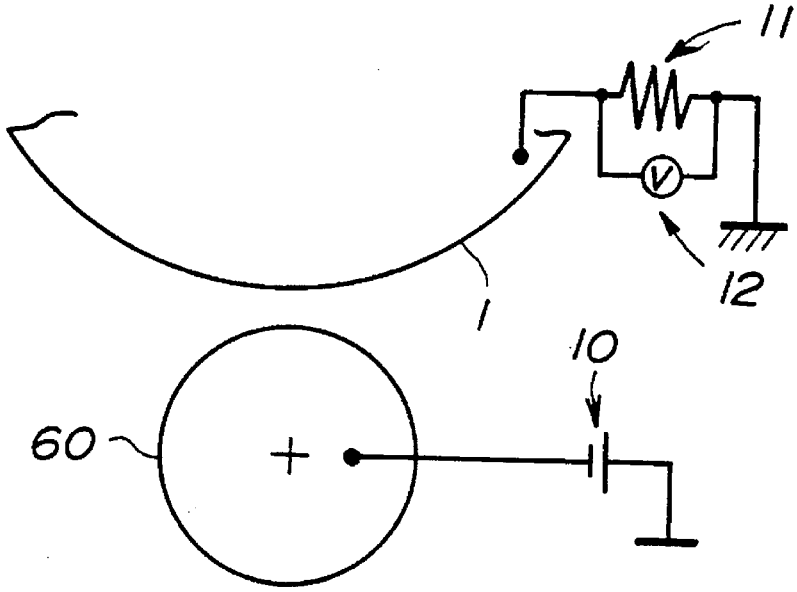
Figure 10:
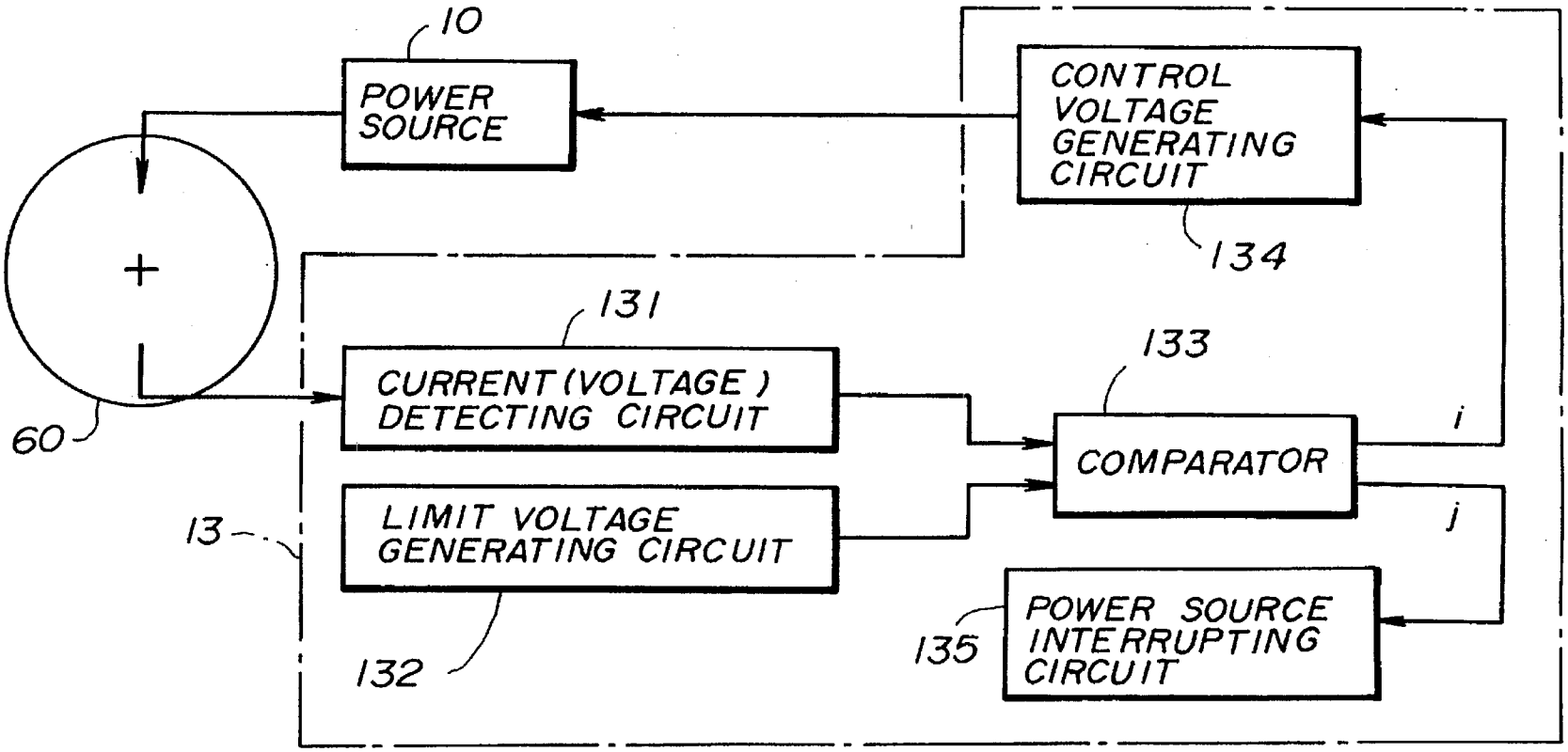
FIG. 10 is a block diagram of a control unit for controlling the voltage supplied to the electric field roller.

In order to eliminate the above-mentioned problem, a control unit 13 (shown in FIG. 10) and a current (voltage) detecting circuit as current detecting means may be provided. The current (voltage) detecting circuit detects the current flowing between the electric field roller 60 and the photosensitive drum 1. The control unit controls the on/off state of a constant voltage supply source 10 supplying a voltage to the electric field roller 60. The on/off state of the constant voltage supply source is determined based on the result of detection of the current (voltage) detecting circuit. The current (voltage) detecting circuit comprises, as shown in FIG. 9A, a resistor element 11 having a predetermined resistance and a voltage meter 12 connected in paralell to the resistor element 11. The resistor element is connected between the electric field roller 60 and the constant voltage supplying source 10. The current flowing from the electric roller 60 to the photosensitive drum 1 can be obtained based on a resistance of the resistor element 11 and a voltage difference across the resistor element 11 which is measured by the voltage meter 12. In an alternative arrangement, the current (voltage) detecting circuit can be provided between an electrically conductive body of the photosensitive drum 1 and the ground. A current meter may be used instead of the current (voltage) detecting circuit comprising the resistor element 11 and the voltage meter 12. The control unit 13 comprises, as shown in FIG. 10, a current (voltage) detecting circuit 131, a limit voltage generating circuit 132, a comparator 133, a control voltage generating circuit 134 and a power source interrupting circuit 135. The current (voltage) detecting circuit 131 is the same as that shown in FIGS. 9A and 9B. The limit voltage generating circuit generates a maximum voltage corresponding to a lower limit of the current flowing to the electric field roller 60 and a minimum voltage corresponding to an upper limit of the current. The comparator 133 compares output signals from the current (voltage) detecting circuit 131 and the limit voltage generating circuit 132. The control voltage generating circuit 134 generates a control signal based on the result of comparison performed by the comparator 133. The power source interrupting circuit 135 interrupts power supplied by the constant voltage supplying source 10.

In the above-mentioned control unit 13, the voltage value corresponding to the current detected by the current (voltage) detecting circuit 131 is compared with the maximum voltage and the minimum voltage output from the limit voltage generating circuit 132. If the voltage value falls within a range between the maximum voltage and the minimum voltage, the comparator 133 outputs a control signal i to the control voltage generating circuit 134 to drive the power source 10. If the voltage value is greater than the maximum voltage or less than the minimum voltage, the comparator 133 outputs a control signal j to the power source interrupting circuit 135 to interrupt the power source 10. Accordingly, if an abnormal condition occurs in the photosensitive drum 1 or the electric field roller 60 such as a partial damage of the photosensitive drum 1 or an adhesion of foreign material onto the electric field roller 60, the power source 10 is interrupted so that the electric field does not concentrate in such an abnormal area. This prevents damage of the photosensitive drum 1 or the electric field roller 60 due to concentration of the electric field. The upper limit of the current flowing between the photosensitive drum 1 and the electric field roller 60 is determined based on a limit of current per unit length of the photosensitive drum 1 in the axial direction of the photosensitive drum 1. Normally, the current corresponding to the upper limit is about 50 μA/cm in the axial direction of the photosensitive drum 1. The lower limit of the current is determined based on the current per unit length wherein the condensing effect of the toner image begins to increase remarkably. Normally, the current per unit length corresponding to the lower limit is about 1 μA/cm. It should be noted that if the voltage value is greater than the maximum voltage or less than the minimum voltage, a notification indicating an occurrence of an abnormal condition may be displayed on display means such as an operational panel.

Figure 11B:
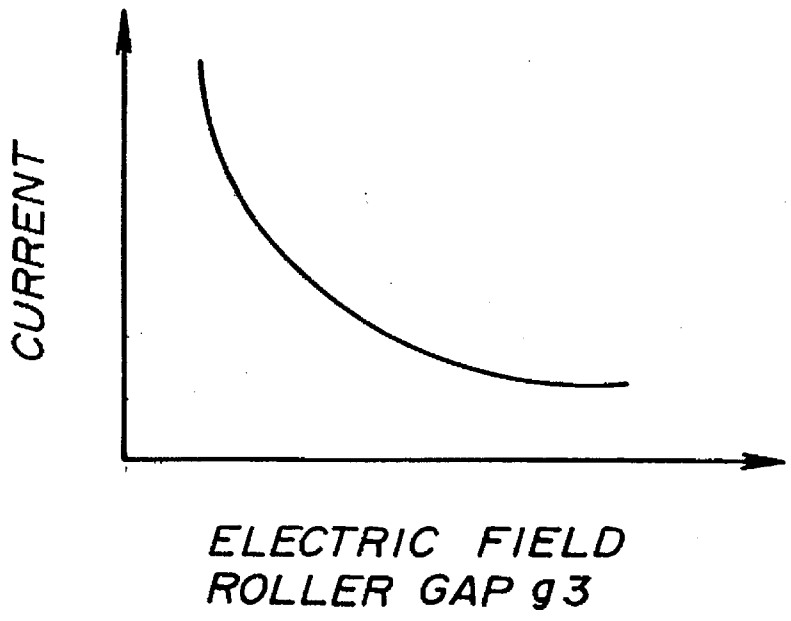
FIG. 11B is a graph showing a relationship between the current flowing between the photosensitive drum and the electric field roller and a width of a gap formed between the photosensitive drum and the electric field roller.
Figure 11A:
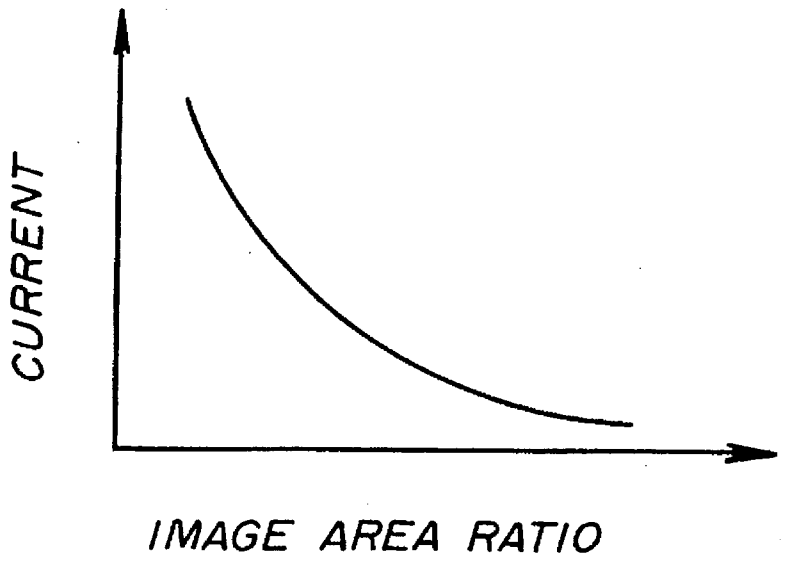
FIG. 11A is a graph showing a relationship between the current flowing between the photosensitive drum 1 and an image area ratio.

As indicated by the graph shown in FIG. 11A, the current flowing to the electric field roller 60 is decreased when a ratio (hereinafter referred to as an image area ratio) of the toner image area to the blank area is increased. Since the condensing force or adhesion force of the toner image is determined by a current per unit area, the condensing force or the adhesion force is varied as the image area ratio varies. Additionally, as indicated by the graph shown in FIG. 11B, the current flowing to the electric field roller 60 is decreased as the electric field roller gap g3 is increased.

Figure 12:
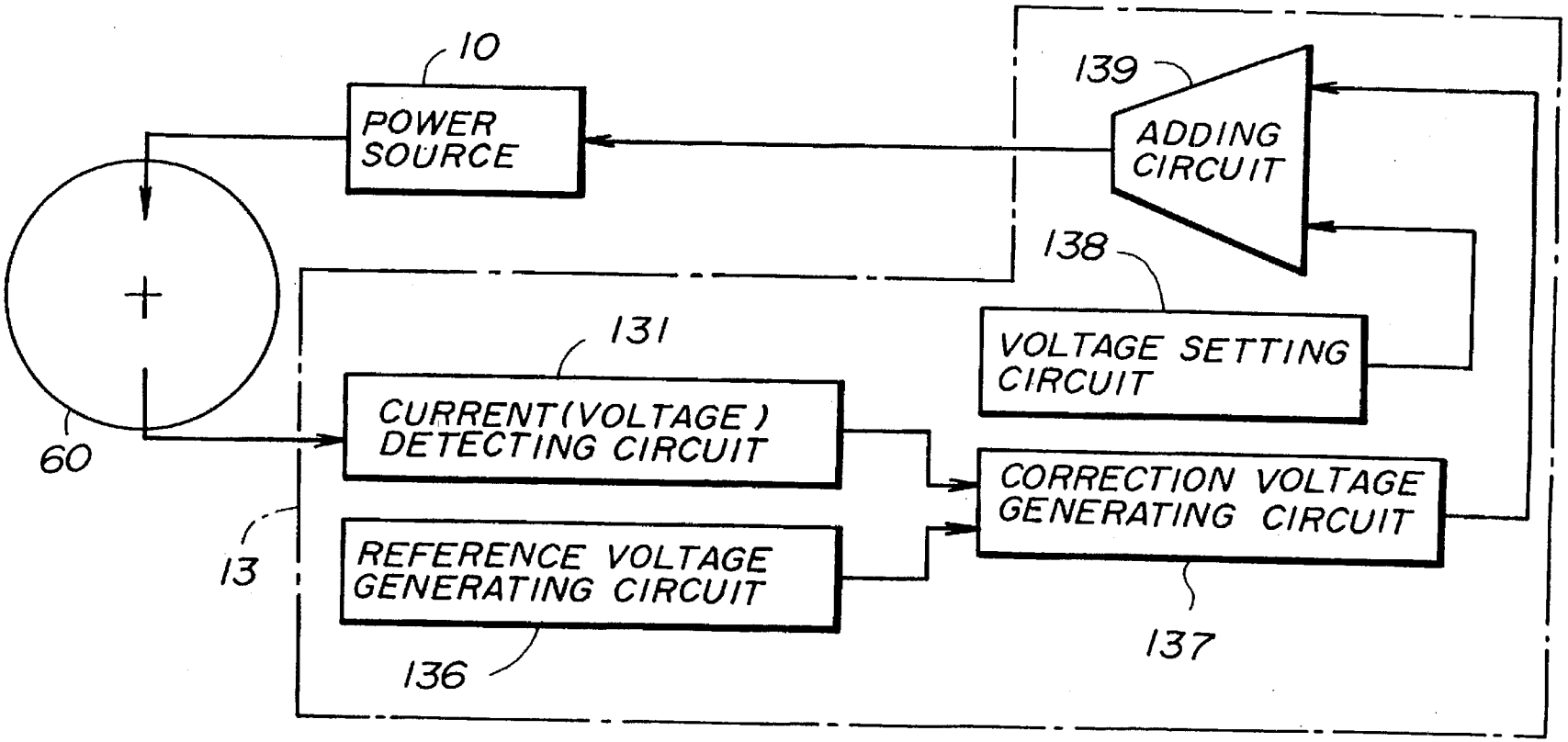
FIG. 12 is a block diagram of a control unit for controlling the voltage supplied to the electric field roller.

In order to maintain the current flowing to the electric field roller 60 to be constant, the control unit 13 may be constituted as shown in FIG. 12. In the control unit shown in FIG. 12, the voltage value output from the current (voltage) detecting circuit 131 and a reference voltage generated by a reference voltage generating circuit 136 are supplied to a correction voltage generating circuit 137. The correction voltage generating circuit 137 generates a correction voltage which is a difference between the voltage value and the reference value, and supplies the correction voltage to an adding circuit 139. The adding circuit 139 adds the correction voltage to a setting control voltage generated by a voltage setting circuit 138 so as to generate a control voltage. The control voltage is supplied to the power source 10 so that the power source 10 controls the voltage supplied to the electric field roller 60 to be constant. Thus, the current flowing between the electric field roller 60 and the photosensitive drum 1 is maintained constant, resulting in a stable toner condensing effect. It should be noted that the reference voltage output from the reference voltage generating circuit is preferably set to an appropriate voltage so that the current flowing between the electric field roller 60 and the photosensitive drum 1 falls between 50 μA/cm and 1 μA/cm.

Figure 13:
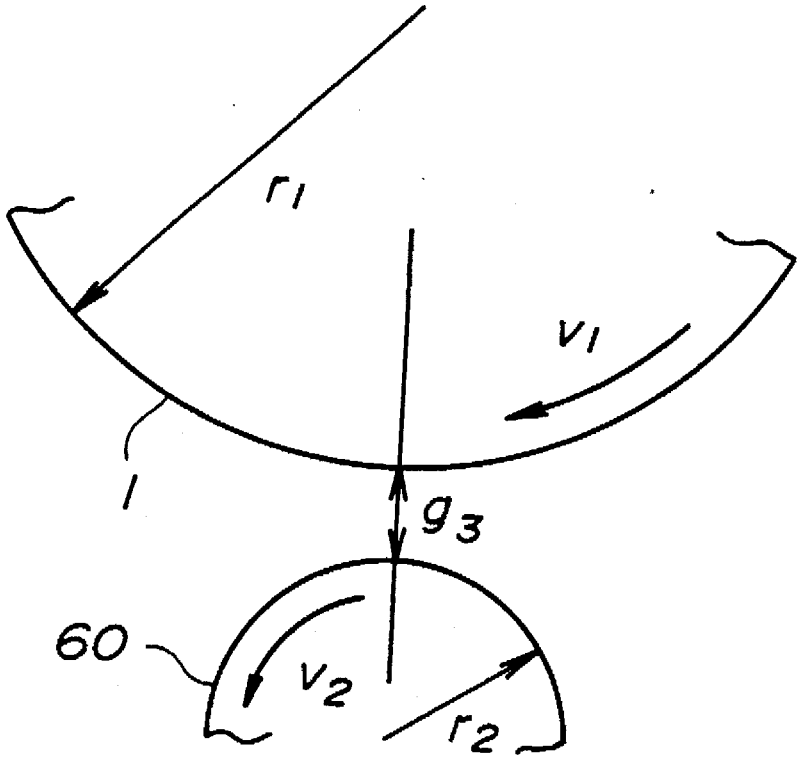
FIG. 13 is an illustration for showing a positional relationship between the electric field roller and the photosensitive drum.

Since the photosensitive drum 1 and the electric field roller 60 are rotated, the width of the electric field roller gap g3 fluctuates if there is an eccentricity in the center of one of the photosensitive drum 1 and the electric field roller 60. This causes a fluctuation of the condensing force or the adhesion force of the toner image. FIG. 13 is an illustration for showing a positional relationship between the electric field roller 60 and the photosensitive drum 1. In FIG. 13, r1 indicates a radius of the photosensitive drum 1, r2 a radius of the electric field roller 60, v1 a circumferential speed of the photosensitive drum 1, and v2 a circumferential speed of the electric field roller 60. The fluctuation g3(t) of the width of the gap g3 with respect to elapsed time is expressed by the following equation.

$$g3(t)=A1\cdot\sin(t/T1)+A2\cdot\sin((t/T2)+\Theta)$$

$$T1=2\pi r1/v1, T2=2\pi r2/v2$$

Where A1 is an amount of eccentricity of the photosensitive drum 1;

A2 is an amount of eccentricity of the electric field roller 60;

Θ is a phase angle between directions of the eccentricity of the photosensitive drum 1 and the electric field roller 60;

T1 is a cycle time of the rotation of the photosensitive drum 1;

T2 is a cycle time of the rotation of the electric field roller 60.

Figure 14:
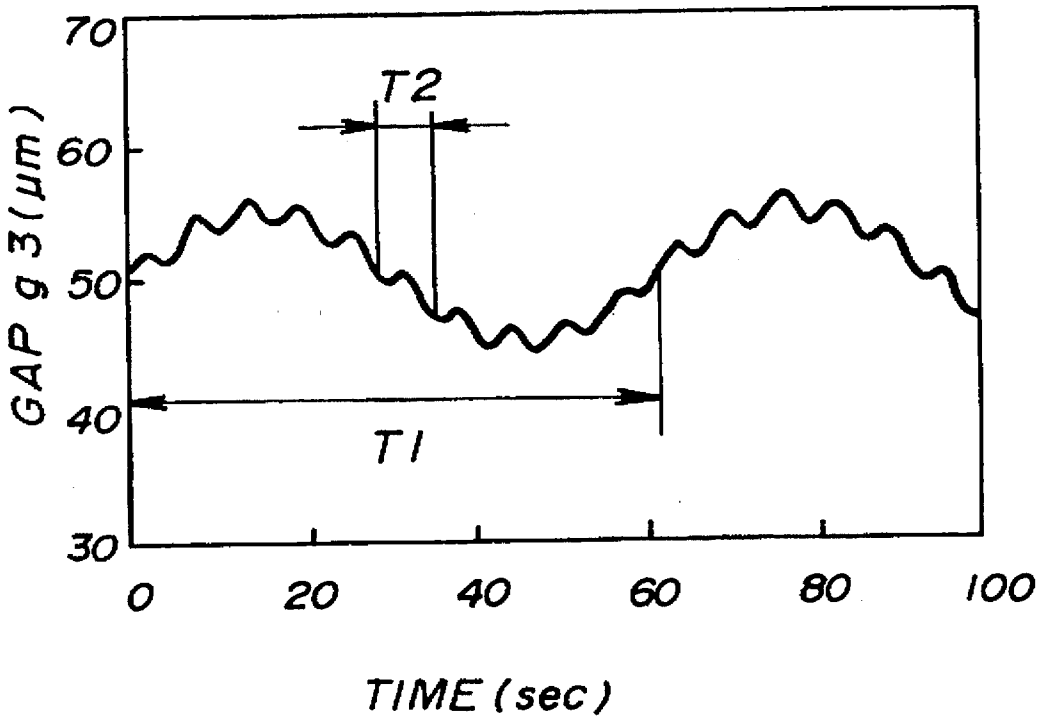
FIG. 14 is a graph showing a fluctuation in the width of a gap between the electric field roller and the photosensitive drum with respect to elapsed time.

FIG. 14 is a graph showing the fluctuation g3(t) of the width of the gap g3 with respect to elapsed time. When the width of the electric field roller gap g3 fluctuates as shown in FIG. 14, the current flowing to the electric field roller 60 also fluctuates. Thus, an undesirable fluctuation occurs in the adhesion force of the toner image to the photosensitive drum 1.

In order to correct the fluctuation in the current flowing to the electric field roller 60, a driving condition of the photosensitive drum 1 and the electric field roller 60 may be set so that the cycle times T1 and T2 satisfy the relationship T1=n·T2 or T2=n·T1 (n is a natural number, i.e., a positive integer). Specifically, the current flowing to the electric field roller 60 is measured at a predetermined time interval under a constant voltage supplied to the electric field roller 60. The data of the measured current and the corresponding time data are stored in a memory provided in the control unit 13. When an actual image forming operation is performed, the output of the power source 10 is controlled so that an appropriate voltage is supplied to the electric field roller 60 in accordance with the current data and the corresponding time data. That is, the fluctuation in the current is detected beforehand from the current data and the voltage supplied to the electric field roller 60 is varied to correct the fluctuation in the current at the time interval. The current may be measured for every predetermined rotational angle of the photosensitive drum 1 or the electric field roller 60. The current should be measured for the cycle time T1 or T2, whichever is greater. In order to simplify the correction operation, the photosensitive drum 1 and the electric roller 60 are stopped at the same time so that the phase angle Θ is maintained, that is, the angular relationship between the photosensitive drum 1 and the electric field roller 60 is maintained the same.

Additionally, in the above mentioned embodiments, the constant voltage power source 10 may be replaced by a constant current power source which supplies a constant current to the electric field roller 60. In such a case, similar to the above mentioned embodiments, damage to the photosensitive drum 1 or the electric field roller 60 should be prevented by monitoring the output voltage of the constant current power source. If the output voltage departs from a predetermined reference voltage, it is preferable to interrupt the image forming operation and display the occurrence of an abnormal condition on an operational panel.

The present invention is not limited to the specifically disclosed embodiments, and variations and modifications may be made without departing from the scope of the present invention.

What is claimed is:

1. A wet-type image forming apparatus comprising:

a latent image carrier carrying a latent image formed thereon;

developing means for developing the latent image formed on said latent image carrier, a toner image being formed by developing the latent image by using a developing liquid including a liquid carrier and toner dispersed in the liquid carrier;

excessive liquid removing means for removing an excessive amount of the liquid carrier on said latent image carrier after formation of the toner image on said latent image carrier;

electric field generating means for generating an electric field so as to cause a current to flow between said electric field generating means and said latent image carrier, an air gap being formed between the liquid carrier on said latent image carrier and said electric field generating means so that the current flows through said gap, the liquid carrier and the toner image;

wherein said electric field is formed so that an absolute value of a potential of a surface of said latent image carrier is decreased, the toner image being formed on said surface of said latent image carrier; and transferring means for transferring the toner image on said latent image carrier to a transfer material after the toner image has passed an area in which said electric field is generated.

2. The wet-type image forming apparatus as claimed in claim 1, wherein said electric field is formed so that toner particles constituting the toner image in the liquid carrier move toward a surface of said latent image carrier, the toner particles being electrically charged.

3. The wet-type image forming apparatus as claimed in claim 1, wherein said electric field is formed so that a weight ratio of toner particles in the toner image to an entire toner image is increased.

4. The wet-type image forming apparatus as claimed in claim 1, wherein said electric field generating means comprises:

an electrically conductive member made of electrically conductive material positioned adjacent to said latent image carrier, said gap being formed between said electrically conductive member and said latent image carrier; and a power source providing a voltage to said electrically conductive member so as to generate said electric field between said electrically conductive member and said latent image carrier.

5. The wet-type image forming apparatus as claimed in claim 4, wherein said electrically conductive member comprises an electric field roller having a rotational axis perpendicular to a direction of movement of the toner image formed on said latent image carrier, said electric field roller being rotated when an image forming operation is performed.

6. The wet-type image forming apparatus as claimed in claim 5, further comprising removing means for removing a substance adhering on said electric field roller.

7. The wet-type image forming apparatus as claimed in claim 5, wherein said latent image carrier comprises a rotational member having a drum-like shape on which the latent image is formed, said rotational member being rotated when the image forming operation is performed, said electric field being generated only when said rotational member and said electric field roller are rotated.

8. The wet-type image forming apparatus as claimed in claim 4, wherein said electrically conductive member comprises a plate member, a flat surface of said plate member facing said latent image carrier.

9. The wet-type image forming apparatus as claimed in claim 4, wherein said electrically conductive member comprises an electric discharge device having a discharge wire extending in a direction perpendicular to a direction of movement of the toner image on said latent image carrier is moved.

10. The wet-type image forming apparatus as claimed in claim 4, wherein said power source comprises a constant current supplying source which supplies the voltage to said electrically conductive member so as to maintain a constant current flowing to said electrically conductive member.

11. The wet-type image forming apparatus as claimed in claim 1, wherein said electric field is formed so that one of a non-pulsed corona discharge and a grow discharge is generated between said latent image carrier and said electric field generating means.

12. A wet-type image forming apparatus comprising:

a latent image carrier carrying a latent image formed thereon;

developing means for developing the latent image formed on said latent image carrier, a toner image being formed by developing the latent image by using a developing liquid including a liquid carrier and toner dispersed in the liquid carrier;

excessive liquid removing means for removing an excessive amount of the liquid carrier on said latent image carrier after formation of the toner image on said latent image carrier;

electric field generating means for generating an electric field so as to cause a current to flow between said electric field generating means and said latent image carrier, an air gap being formed between the liquid carrier on said latent image carrier and said electric field generating means so that the current flows through said gap, the liquid carrier and the toner image, wherein said electric field generating means comprises, an electrically conductive member made of electrically conductive material positioned adjacent to said latent image carrier, said gap being formed between said electrically conductive member and said latent image carrier, and a power source providing a voltage to said electrically conductive member so as to generate said electric field between said electrically conductive member and said latent image carrier;

wherein said electrically conductive member comprises an electric field roller having a rotational axis perpendicular to a direction of movement of the toner image formed on said latent image carrier, said electric field roller being rotated when an image forming operation is performed;

transferring means for transferring the toner image on said latent image carrier to a transfer material after the toner image has passed an area in which said electric field is generated; and wherein a resistive layer having a predetermined resistance is provided on an outer surface of said electric field roller.

13. A wet-type image forming apparatus comprising:

a latent image carrier carrying a latent image formed thereon;

developing means for developing the latent image formed on said latent image carrier, a toner image being formed by developing the latent image by using a developing liquid including a liquid carrier and toner dispersed in the liquid carrier;

excessive liquid removing means for removing an excessive amount of the liquid carrier on said latent image carrier after formation of the toner image on said latent image carrier;

electric field generating means for generating an electric field so as to cause a current to flow between said electric field generating means and said latent image carrier. an air gap being formed between the liquid carrier on said latent image carrier and said electric field generating means so that the current flows through said gap, the liquid carrier and the toner image, wherein said electric field generating means comprises, an electrically conductive member made of electrically conductive material positioned adjacent to said latent image carrier, said gap being formed between said electrically conductive member and said latent image carrier, and a power source providing a voltage to said electrically conductive member so as to generate said electric field between said electrically conductive member and said latent image carrier;

wherein said electrically conductive member comprises an electric field roller having a rotational axis perpendicular to a direction of movement of the toner image formed on said latent image carrier, said electric field roller being rotated when an image forming operation is performed;

transferring means for transferring the toner image on said latent image carrier to a transfer material after the toner image has passed an area in which said electric field is generated; and wherein said developing means comprises a developing roller which applies the developing liquid to said latent image carrier, and said excessive liquid removing means comprises a squeeze roller which contacts the liquid carrier on said latent image carrier to remove an excessive amount of the liquid carrier, wherein a third distance between said electric field roller and said latent image carrier is equal to or less than a first distance between said developing roller and said latent image carrier, said third distance being greater than a second distance between said squeeze roller and said latent image carrier.

14. A wet-type image forming apparatus comprising:

a latent image carrier carrying a latent image formed thereon;

developing means for developing the latent image formed on said latent image carrier, a toner image being formed by developing the latent image by using a developing liquid including a liquid carrier and toner dispersed in the liquid carrier;

excessive liquid removing means for removing an excessive amount of the liquid carrier on said latent image carrier after formation of the toner image on said latent image carrier;

electric field generating means for generating an electric field so as to cause a current to flow between said electric field generating means and said latent image carrier, an air gap being formed between the liquid carrier on said latent image carrier and said electric field generating means so that the current flows through said gap, the liquid carrier and the toner image, wherein said electric field generating means comprises, an electrically conductive member made of electrically conductive material positioned adjacent to said latent image carrier, said gap being formed between said electrically conductive member and said latent image carrier, and a power source providing a voltage to said electrically conductive member so as to generate said electric field between said electrically conductive member and said latent image carrier;

wherein said electrically conductive member comprises a plate member, a flat surface of said plate member facing said latent image carrier;

transferring means for transferring the toner image on said latent image carrier to a transfer material after the toner image has passed an area in which said electric field is generated; and wherein a resistive layer having a predetermined resistance is provided on said flat surface of said plate member.

15. A wet-type image forming apparatus comprising:

a latent image carrier carrying a latent image formed thereon;

developing means for developing the latent image formed on said latent image carrier, a toner image being formed by developing the latent image by using a developing liquid including a liquid carrier and toner dispersed in the liquid carrier;

excessive liquid removing means for removing an excessive amount of the liquid carrier on said latent image carrier after formation of the toner image on said latent image carrier;

electric field generating means for generating an electric field so as to cause a current to flow between said electric field generating means and said latent image carrier, an air gap being formed between the liquid carrier on said latent image carrier and said electric field generating means so that the current flows through said gap, the liquid carrier and the toner image, wherein said electric field generating means comprises, an electrically conductive member made of electrically conductive material positioned adjacent to said latent image carrier, said gap being formed between said electrically conductive member and said latent image carrier, and a power source providing a voltage to said electrically conductive member so as to generate said electric field between said electrically conductive member and said latent image carrier; transferring means for transferring the toner image on said latent image carrier to a transfer material after the toner image has passed an area in which said electric field is generated; and wherein said power source comprises a constant voltage supplying source providing a constant voltage to said electrically conductive member so that said electric field has a constant intensity, said electric field generating means further comprises current detecting means for detecting a current flowing between said electrically conductive member and said latent image carrier and controlling means for controlling said constant voltage supplying source so that the constant voltage provided to said electrically conductive member is varied in accordance with the current detected by said current detecting means.

16. The wet-type image forming apparatus as claimed in claimed 13, wherein said electrically conductive member comprises an electric field roller having a rotational axis perpendicular to a direction of movement of the toner image formed on said latent image carrier, said electric field roller being rotated when an image forming operation is performed, said latent image carrier comprises a rotational member having a drum-like shape on which the latent image is formed, said rotational member being rotated when the image forming operation is performed, wherein rotational speeds of said electric field roller and said rotational member being determined to satisfy one of a relationship of $T1=n \cdot T2$ and $T2=n \cdot T1$, where T1 is a cycle time of rotation of said rotational member, T2 is a cycle time of rotation of said electric field roller and n is a natural number.

17. The wet-type image forming apparatus as claimed in claim 16, wherein the current is measured during one of the cycle times T1 and T2 having a greater value at a predetermined time interval, and the constant voltage applied to said electric field roller is varied at the predetermined time interval.

18. The wet-type image forming apparatus as claimed in claim 16, wherein the current is measured during one of the cycle times T1 and T2 having a greater value at each predetermined rotational angle of one of said rotational drum and said electric field roller which as a greater cycle time, and the constant voltage applied to said electric field roller is varied at the each predetermined rotational angle.

19. The wet-type image forming apparatus as claimed in claim 16, wherein rotation of said rotational member and rotation of said electric field roller is stopped at the same time.

20. A wet-type image forming apparatus comprising:

a latent image carrier carrying a latent image formed thereon;

developing means for developing the latent image formed on said latent image carrier, a toner image being formed by developing the latent image by using a developing liquid including a liquid carrier and toner dispersed in the liquid carrier;

excessive liquid removing means for removing an excessive amount of the liquid carrier on said latent image carrier after formation of the toner image on said latent image carrier;

electric field generating means for generating an electric field so as to cause a current to flow between said electric field generating means and said latent image carrier, an air gap being formed between the liquid carrier on said latent image carrier and said electric field generating means so that the current flows through said gap, the liquid carrier and the toner image, wherein said electric field generating means comprises, an electrically conductive member made of electrically conductive material positioned adjacent to said latent image carrier, said gap being formed between said electrically conductive member and said latent image carrier, and a power source providing a voltage to said electrically conductive member so as to generate said electric field between said electrically conductive member and said latent image carrier;

transferring means for transferring the toner image on said latent image carrier to a transfer material after the toner image has passed an area in which said electric field is generated; and wherein said power source comprises a constant voltage supplying source providing a constant voltage to said electrically conductive member so that said electric field has a constant intensity, said electric field generating means further comprises current detecting means for detecting a current flowing between said electrically conductive member and said latent image carrier and controlling means for controlling said constant voltage supplying source so that the constant voltage provided to said electrically conductive member is interrupted when the current detected by said current detecting means is outside of a predetermined current range.

21. The wet-type image forming apparatus as claimed in claim 20, wherein an abnormal condition is notified to a user when the current detected by said current detecting means is outside of the predetermined current range.

22. The wet-type image forming apparatus as claimed in claim 20, wherein said electrically conductive member comprises an electric field roller having a rotational axis perpendicular to a direction of movement of the toner image formed on said latent image carrier, said electric field roller being rotated when an image forming operation is performed, said predetermined current range being defined in a current per unit length from 1 μA/cm to 50 μA/cm in a direction of the rotational axis of said electric field roller.

23. A wet-type image forming apparatus comprising:

a latent image carrier carrying a latent image formed thereon;

developing means for developing the latent image formed on said latent image carrier, a toner image being formed by developing the latent image by using a developing liquid including a liquid carrier and toner dispersed in the liquid carrier;

excessive liquid removing means for removing an excessive amount of the liquid carrier on said latent image carrier after formation of the toner image on said latent image carrier;

electric field generating means for generating an electric field so as to cause a current to flow between said electric field generating means and said latent image carrier, an air gap being formed between the liquid carrier on said latent image carrier and said electric field generating means so that the current flows through said gap, the liquid carrier and the toner image, wherein said electric field generating means comprises, an electrically conductive member made of electrically conductive material positioned adjacent to said latent image carrier, said gap being formed between said electrically conductive member and said latent image carrier, and a power source providing a voltage to said electrically conductive member so as to generate said electric field between said electrically conductive member and said latent image carrier;

wherein said power source comprises a constant current supplying source which supplies the voltage to said electrically conductive member so as to maintain a constant current flowing to said electrically conductive member;

transferring means for transferring the toner image on said latent image carrier to a transfer material after the toner image has passed an area in which said electric field is generated; and said wet-type image forming apparatus further comprising:

voltage detecting means for detecting the voltage applied to said electrically conductive member; and controlling means for controlling said constant current supplying source to interrupt the voltage applied to said electrically conductive member when the voltage detected by said voltage detecting means is outside of a predetermined voltage range.

24. The wet-type image forming apparatus as claimed in claim 23, wherein an abnormal condition is notified to a user when the voltage detected by said voltage detecting means is outside of the predetermined voltage range.

* * * * *